US011024956B2

(12) United States Patent
Hamabe

(10) Patent No.: US 11,024,956 B2
(45) Date of Patent: Jun. 1, 2021

(54) ANTENNA DEVICE

(71) Applicant: Panasonic Intellectual Property Management Co., Ltd., Osaka (JP)

(72) Inventor: Taichi Hamabe, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 16/812,759

(22) Filed: Mar. 9, 2020

(65) Prior Publication Data

US 2020/0212558 A1 Jul. 2, 2020

Related U.S. Application Data

(60) Division of application No. 15/918,327, filed on Mar. 12, 2018, now abandoned, which is a continuation of application No. PCT/JP2016/004234, filed on Sep. 16, 2016.

(30) Foreign Application Priority Data

Sep. 25, 2015 (JP) ..... 2015-188479

(51) Int. Cl.

| | |
|---|---|
| ***H01Q 1/48*** | (2006.01) |
| ***H01Q 1/38*** | (2006.01) |
| ***H01Q 1/22*** | (2006.01) |
| ***H01Q 9/04*** | (2006.01) |

(52) U.S. Cl.

CPC ..... *H01Q 1/48* (2013.01); *H01Q 1/2291* (2013.01); *H01Q 1/38* (2013.01); *H01Q 9/0421* (2013.01); *H01Q 9/0457* (2013.01)

(58) Field of Classification Search

CPC ..... H01Q 1/48; H01Q 1/38; H01Q 1/2291; H01Q 9/0421; H01Q 9/0457

See application file for complete search history.

(56) References Cited

U.S. PATENT DOCUMENTS

| | | | | |
|---|---|---|---|---|
| 5,917,458 | A | 6/1999 | Ho | |
| 2005/0195110 | A1 | 9/2005 | Lin | |
| 2010/0214179 | A1 | 8/2010 | Wong | |
| 2012/0242547 | A1* | 9/2012 | Fujii | H01Q 9/0414 343/700 MS |

(Continued)

FOREIGN PATENT DOCUMENTS

| | | |
|---|---|---|
| JP | 4-27609 | 3/1992 |
| JP | 6-276007 | 9/1994 |

(Continued)

OTHER PUBLICATIONS

International Search Report dated Oct. 18, 2016 in International Application No. PCT/JP2016/004234.

*Primary Examiner* — Hoang V Nguyen
(74) *Attorney, Agent, or Firm* — Wenderoth, Lind & Ponack, L.L.P.

(57) ABSTRACT

Antenna device includes substrate, antenna formed on front side of substrate, first ground formed on front side of substrate, and second ground formed on back side of the substrate. Second ground is larger in area than antenna and larger in area than first ground. First ground is insulated from antenna and is connected with second ground through an end of substrate. Consequently, overall antenna device can come down in size while maintaining a capability of antenna.

10 Claims, 5 Drawing Sheets

(56) References Cited

U.S. PATENT DOCUMENTS

2012/0287019 A1* 11/2012 Sudo ..... H01Q 9/045
343/904

FOREIGN PATENT DOCUMENTS

| | | |
|---|---|---|
| JP | 2005-311685 | 11/2005 |
| JP | 2007-142570 | 6/2007 |
| JP | 2013-78027 | 4/2013 |

* cited by examiner

ANTENNA DEVICE

TECHNICAL FIELD

The present disclosure relates to a planar antenna device.

BACKGROUND ART

PTL 1 discloses a patch antenna that is an example of the planar antenna device.

CITATION LIST

Patent Literature

PTL 1: Unexamined Japanese Patent Publication No. 2013-78027

SUMMARY OF THE INVENTION

The present disclosure provides an antenna device that can overall come down in size while maintaining a capability essential for an antenna.

An antenna device according to the present disclosure includes a substrate, an antenna formed on a front side of the substrate, a first ground formed on the front side of the substrate, and a second ground formed on a back side of the substrate. The second ground is larger in area than the antenna and larger in area than the first ground. The first ground is insulated from the antenna and is connected with the second ground through an end of the substrate.

The antenna device according to the present disclosure can overall come down in size while maintaining a capability essential for the antenna.

DESCRIPTION OF EMBODIMENTS

Hereinafter, exemplary embodiments will be described in detail with reference to the drawings as appropriate. However, more detailed description than necessary will be omitted in some cases. For example, the detailed description of well known matters and repeated description of substantially the same configuration may be omitted. This is to avoid the following description from being unnecessarily redundant, and to facilitate understanding of those skilled in the art.

Note that the attached drawings and the following description are provided for those skilled in the art to fully understand the present disclosure, and are not intended to limit the subject matter as described in the appended claims.

Exemplary Embodiment

An exemplary embodiment will now be described with reference to FIGS. 1 to 4.

[1-1. Configuration]

Figure 1:
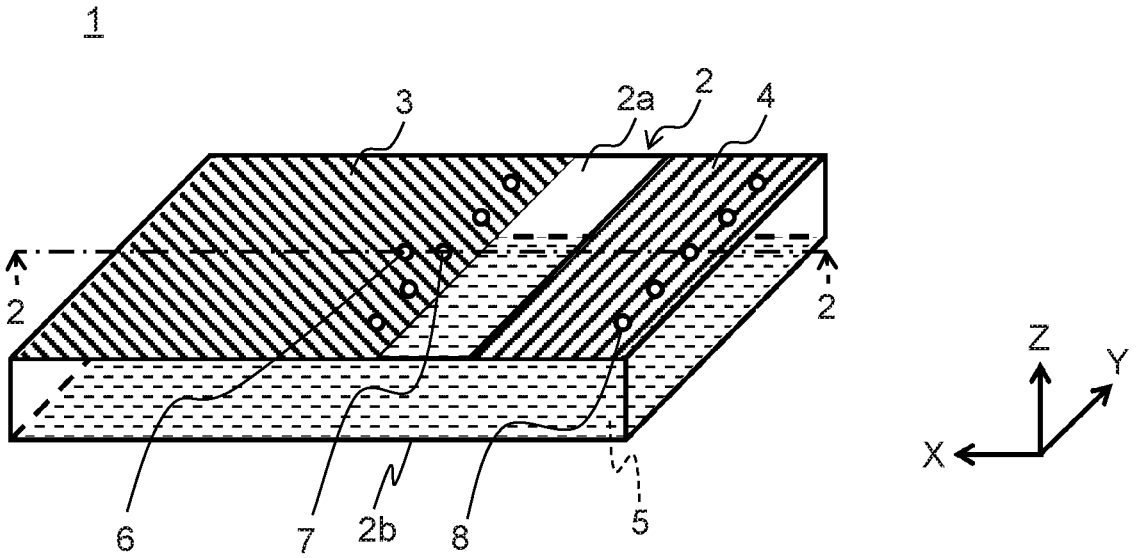
FIG. 1 is an external view of an antenna device according to an exemplary embodiment.
Figure 2:
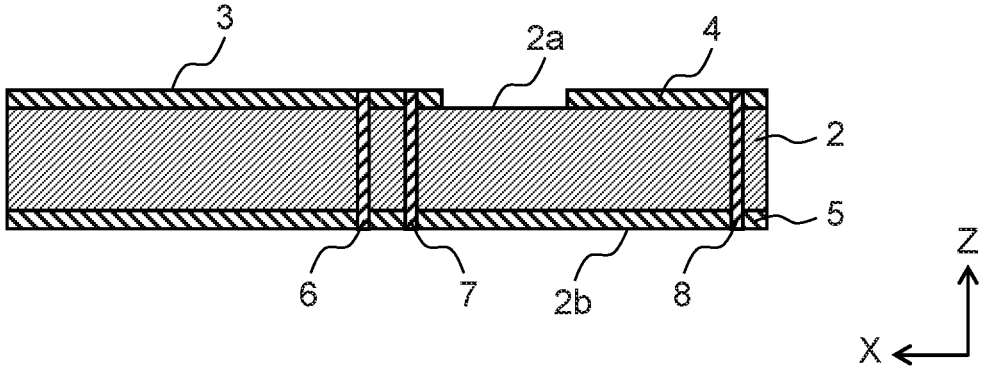
FIG. 2 is a cross-sectional view taken along line 2-2 of FIG. 1.

With reference to FIGS. 1 and 2, a configuration of an antenna device will be described. FIG. 1 is an external view of the antenna device according to the exemplary embodiment. FIG. 2 is a cross-sectional view taken along line 2-2 of FIG. 1.

Antenna device 1 according to this exemplary embodiment is a 2.4 GHz band antenna for use in applications such as Wireless Fidelity (Wi-Fi) and Bluetooth (registered trademark) networks. Antenna device 1 can be applied to various electronic devices put in traveling objects such as vehicles and airplanes, for example.

With reference to FIG. 1, antenna device 1 includes substrate 2, antenna 3, first ground 4, and second ground 5.

Substrate 2 is a glass epoxy substrate, for example and forms a dielectric. Antenna 3 is disposed on front side (top surface) 2*a* of substrate 2. In common with antenna 3, first ground 4 is disposed on front side 2*a* of substrate 2. Antenna 3 and first ground 4 are disposed side by side along a longitudinal direction of substrate 2 (an x-axis). Second ground 5 is disposed throughout back side (undersurface) 2*b* of substrate 2 (an undersurface that does not contain antenna 3).

With reference to FIG. 2, antenna device 1 has vias 6, 7, 8 that are disposed inside a plurality of respective through holes running from front side 2*a* to back side 2*b* of substrate 2. Via 6 connects antenna 3 with a feeding part in an electronic device. Via 6 is slightly shifted from a straight line running through a midpoint of a short side of antenna device 1 and being perpendicular to the short side such that impedance matching for the antenna device is achieved.

A plurality of vias 7 are disposed so as to connect antenna 3 with second ground 5. A plurality of vias 8 are disposed so as to connect first ground 4 with second ground 5. Vias 7 and 8 may be provided in any number other than five pieces each in FIG. 1.

Disposition of vias 8 will be described below. Vias 8 are disposed at an end of substrate 2. First ground 4 is connected with second ground 5 through the end of substrate 2. First and second grounds 4 and 5 that are joined by vias 8 serve as a single ground. Thus, in order to increase an area of the ground, vias 8 should preferably be disposed as close as possible to the very end of substrate 2.

Figure 3:
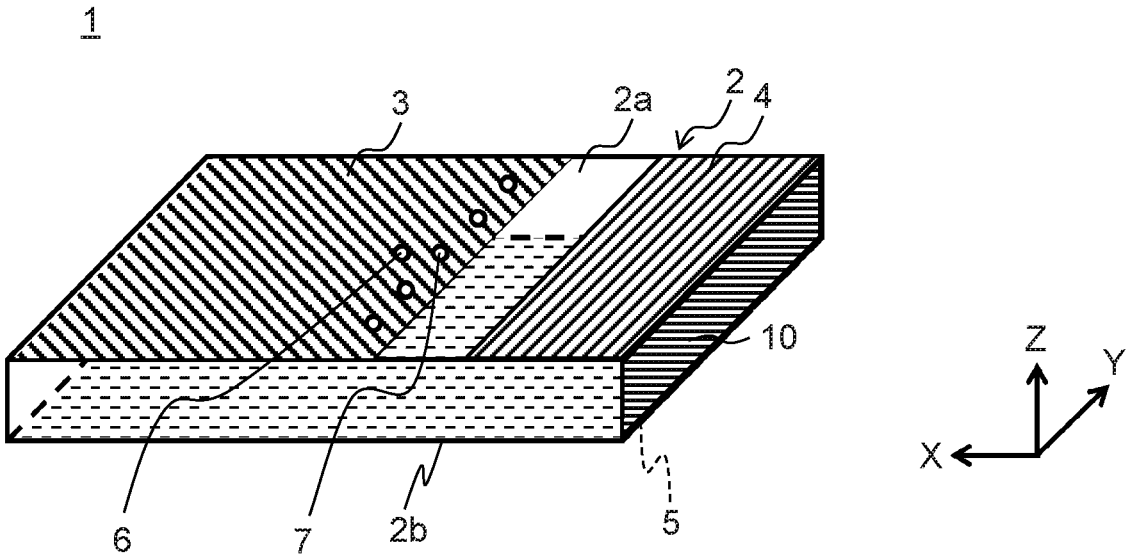
FIG. 3 is an external view of a variation of the antenna device in FIG. 1.
Figure 4:
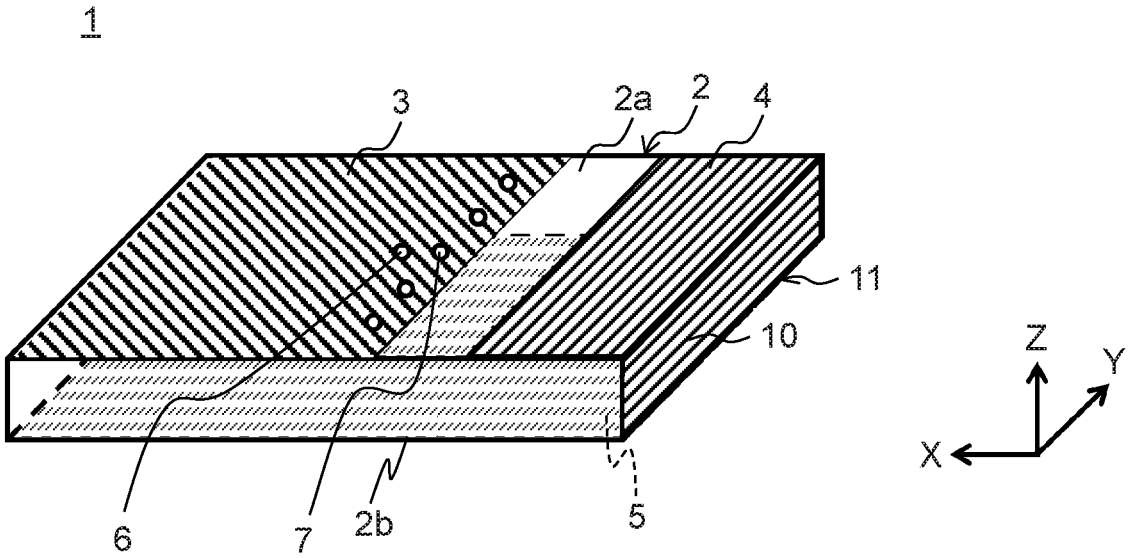
FIG. 4 is an external view of another variation of the antenna device in FIG. 1.

First and second grounds 4 and 5 may be joined without vias 8. With reference to FIG. 3, vias 8 may be replaced by conductor 10 that is disposed on a side surface of substrate 2, for example. With reference to FIG. 4, a single plate of conductor 11 may be bent such that conductor 11 forms first and second grounds 4 and 5, and conductor 10, for example.

Antenna 3 is an electric conductor, such as copper foil, that is formed on front side 2*a* of substrate 2. Antenna 3 is connected with second ground 5 through first ground 4. An area of antenna 3 is about half of a base area of substrate 2.

In common with antenna 3, first ground 4 is an electric conductor, such as copper foil, that is formed on front side 2*a* of substrate 2. A gap is put between first ground 4 and antenna 3 such that these components are insulated from each other even on the same plane. An area of first ground 4 is smaller than the area of antenna 3.

Second ground 5 is an electric conductor, such as copper foil, that is formed on back side 2*b* of substrate 2, i.e. a surface opposite to the surface on which antenna 3 and first ground 4 are formed. In this exemplary embodiment, second ground 5 is disposed throughout back side 2*b* of substrate 2. An area of second ground 5 is larger than each of the areas of antenna 3 and first ground 4 and larger than an aggregate of the areas of antenna 3 and first ground 4.

Antenna 3, first ground 4, and second ground 5 are each shaped like a plate. No particular limitation is placed on the plate shapes of these electric conductors with proviso that the electric conductors have rectangle-, loop-, ring-, or other belt-shaped patterns, for example. The plate shapes include planar shapes in overall configuration.

A background leading to the attainment of an exemplary embodiment of the present disclosure is outlined below. In the case of miniaturizing a patch antenna, miniaturization of the ground is difficult while the antenna part can be miniaturized by the use of a small part such as a small microstrip patch antenna. Accordingly, miniaturization of the overall antenna device has been difficult. However, the configuration described above allows first ground 4 to be disposed in a space created as a result of miniaturization of antenna 3 and thus ensures that an area of the overall ground accounts for a certain percentage or larger of the total surface of substrate 2. This enables antenna device 1 to be provided with substrate 2 having a decreased base area. Consequently, overall antenna device 1 can come down in size.

[1-2. Capability]

Figure 5:
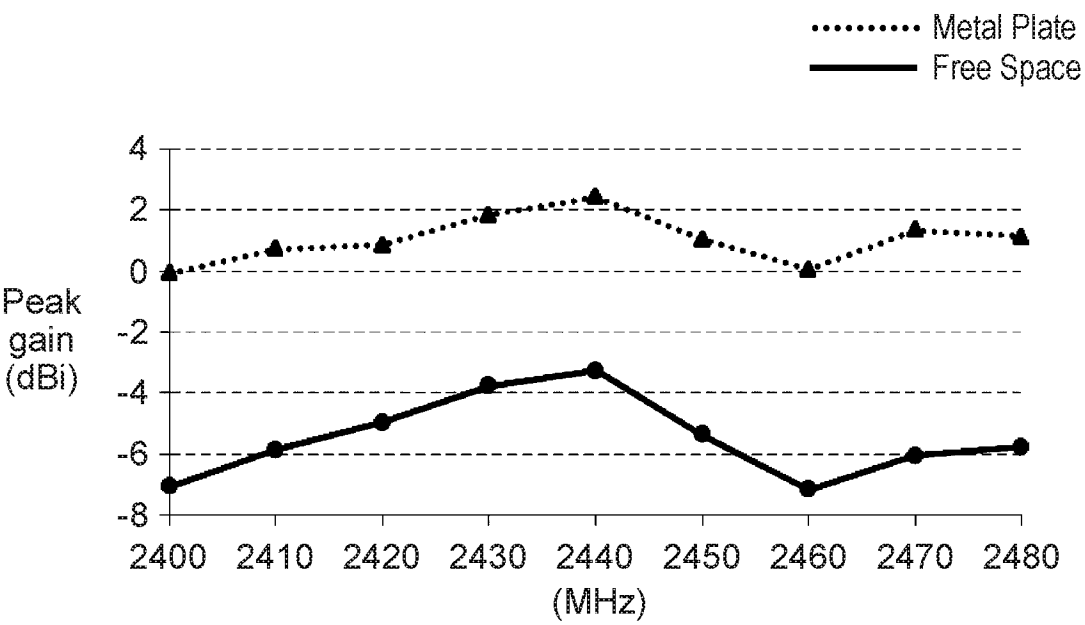
FIG. 5 is a graph illustrating peak gains for the antenna device, represented on an xy-plane.
Figure 6:
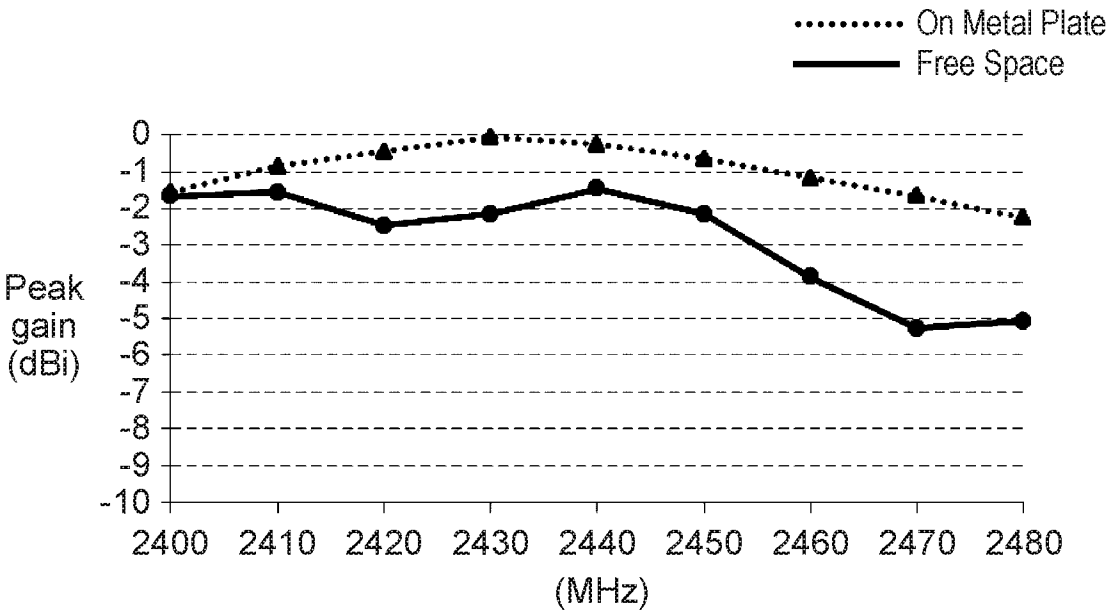
FIG. 6 is a graph illustrating peak gains for an antenna device, represented on an xy-plane.

With reference to FIGS. 5 and 6, a capability of the antenna device configured as described above will now be described. FIG. 5 is a graph illustrating peak gains for the antenna device according to this exemplary embodiment, represented on an xy-plane. FIG. 6 is a graph illustrating peak gains for an antenna device according to a comparative example, represented on an xy-plane.

FIG. 5 shows an antenna capability of antenna device 1 described above with FIGS. 1 and 2. Antenna device 1 (second ground 5) was roughly 25 by 20 millimeters in size (The antenna was roughly 23 by 18 millimeters in size). Antenna device 1 included substrate 2 with a relative dielectric constant of 5.0. Meanwhile, FIG. 6 shows an antenna capability of the antenna device according to the comparative example. The antenna device (the ground) was roughly 50 by 50 millimeters in size (The antenna was roughly 35 by 35 millimeters in size). The antenna device included substrate 2 with a relative dielectric constant of 11.6.

In FIG. 5 (in common with FIG. 6), the horizontal axis represents frequency, and the vertical axis represents gain. The solid line shows peak gains for the antenna device measured in free space, whereas the dotted line shows peak gains for the antenna device measured with a ground side of the antenna device being disposed on a metallic plate. The disposition of the antenna device on the metallic plate herein refers to a supposed case in which the antenna device is put in an electronic device around which other metal parts exist.

In FIG. 5, the peak gain for free space ranged from about −3 dBi to about −7 dBi, whereas the peak gain for on-metallic plate ranged from about 0 dBi to about 2 dBi. This shows that the antenna capability was greater in the case of on-metallic plate than in the case of free space.

Meanwhile, FIG. 6 shows that the peak gain for free space ranged from about −1 dBi to about −5 dBi, whereas the peak gain for on-metallic plate ranged from about −2 dBi to about −0 dBi.

In other words, in the case of being disposed on the metallic plate, i.e. being put in an electronic device, antenna device 1 according to this exemplary embodiment demonstrated up to 2 dBi greater antenna capability than the general conventional patch antenna (at a frequency of 2,430 MHz), and displayed enhanced antenna capability at other frequencies as well.

In other words, the results showed that the antenna capability was maintained even with an antenna device that included a substrate having about 50% lower relative dielectric constant and got about 50% smaller in size according to this exemplary embodiment (an antenna device gets larger in size with a decrease in relative dielectric constant).

[1-3. Effects and Other Benefits]

As described above, this exemplary embodiment enables the disposition of first ground 4 and thereby enables the miniaturization of antenna device 1. Consequently, overall antenna device 1 can come down in size while maintaining an antenna capability.

Other Exemplary Embodiments

As described above, the exemplary embodiment has been described as an example of the technique disclosed in the present application. However, the technique in the present disclosure is not limited thereto, and can also be applied to embodiments in which change, substitution, addition, omission and the like are performed. A new exemplary embodiment can also be made by a combination of the components described in the exemplary embodiment.

Accordingly, other exemplary embodiments will be described below.

In the exemplary embodiment, antenna 3 and first ground 4 are formed on the same plane. However, antenna 3, first ground 4, and second ground 5 may be formed on respective surfaces of a multilayer substrate.

Figure 7:
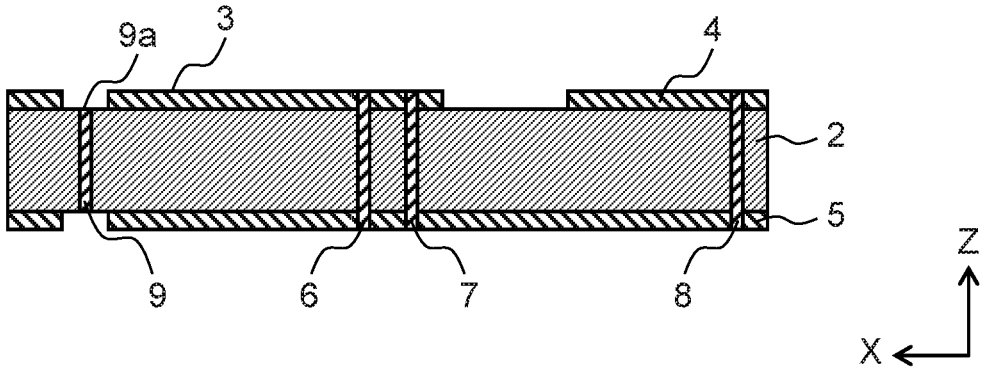
FIG. 7 is a cross-sectional view of an antenna device according to another exemplary embodiment.

In the case of being put in an electronic device, antenna device 1 may have one or more vias that are provided in consideration of other wiring of the electronic device. In such a case, as shown in FIG. 7, substrate 2 has via 9 without electrical connection at a position of antenna 3, and antenna 3 includes hollow 9*a* made up of a hole around an outlet of via 9 such that antenna 3 is not electrically connected to via 9, for example.

This configuration causes antenna device 1 to operate at decreased frequency as compared to antenna device 1 without hollow 9*a*. In order for antenna device 1 to operate at an intended frequency, antenna 3 needs to be further downsized. In other words, inclusion of hollow 9*a* allows antenna device 1 to further come down in size.

Figure 8:
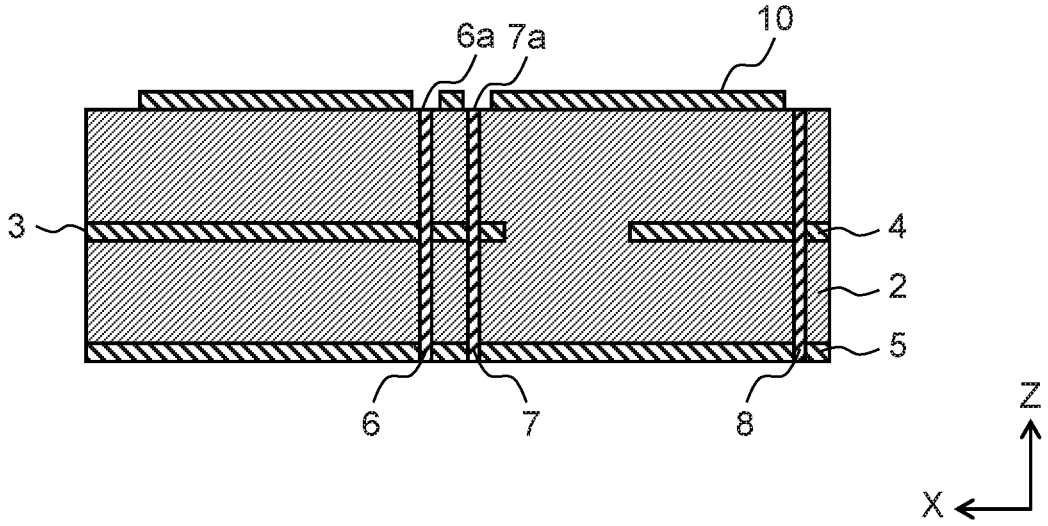
FIG. 8 is a cross-sectional view of an antenna device according to another exemplary embodiment.

With reference to FIG. 8, an antenna device may be made by including parasitic antenna 10. This configuration widens a frequency band over which the antenna device operates and thus allows antenna 3 to be made smaller than antenna 3 without parasitic antenna 10. In this case, parasitic antenna 10 includes hollow 6*a* and hollow 7*a* as in the case of FIG. 7 such that parasitic antenna 10 is not connected to via 6 and via 7. Hollows 6*a*, 7*a*, 9*a* may be each a circle, a triangle or a polygon in cross sectional shape and may be configured in any size with proviso that inner surfaces of hollows 6*a*, 7*a*, and 9*a* do not come into contact with respective vias 6, 7, and 9. Hollows 6*a*, 7*a*, 9*a* may constitute cutouts or slits, for example, other than holes.

The above exemplary embodiments are an illustration of the technique of the present disclosure. Therefore, various changes, replacements, additions, or omissions may be made to the exemplary embodiments within the scope of claims or their equivalents.

INDUSTRIAL APPLICABILITY

An antenna device according to the present disclosure can come down in size. Thus, the antenna device, as an antenna for wireless equipment, can be applied to various electronic devices such as personal computers (PCs), portable devices, and traveling objects (e.g. vehicles, buses, and airplanes).

REFERENCE MARKS IN THE DRAWINGS

1 antenna device
2 substrate
3 antenna
4 first ground
5 second ground
6, 7, 8, 9 via
6*a*, 7*a*, 9*a* hollow
10 parasitic antenna

The invention claimed is:

1. An antenna device comprising:
a substrate including a first surface and a second surface, the first surface being opposite to the second surface;
a parasitic antenna on the first surface;
a second ground on the second surface;
an antenna between the parasitic antenna and the second ground;
a first via connecting the second ground to the antenna;
a first ground between the parasitic antenna and the second ground; and
a second via connecting the first ground to the second ground.

2. The antenna device according to claim 1, wherein an area of the second ground is larger than an area of the first ground.

3. The antenna device according to claim 1, wherein an area of the second ground is larger than an area of the antenna.

4. The antenna device according to claim 1, wherein the first via reaches the first surface.

5. The antenna device according to claim 1, wherein the parasitic antenna includes an opening, and the first via aligns with the opening.

6. The antenna device according to claim 1, wherein the second via reaches the first surface.

7. The antenna device according to claim 1, wherein the antenna and the first ground are on a same plane.

8. The antenna device according to claim 1, further comprising a third via electrically isolated from the antenna and the second ground.

9. The antenna device according to claim 8, wherein the antenna includes an opening, and the third via aligns with the opening.

10. The antenna device according to claim 9, wherein the second ground includes an opening, and the third via aligns with the opening of the second ground.

* * * * *